United States Patent [19]

Allen

[11] Patent Number: 5,065,538

[45] Date of Patent: Nov. 19, 1991

[54] NOCTURNAL RIFLE SIGHT ORGANIZATION

[76] Inventor: Rhandall A. Allen, 12604 Tollhouse Rd., Spotsylvania, Va. 22553

[21] Appl. No.: 527,864

[22] Filed: May 24, 1990

[51] Int. Cl.[5] ..... F41G 1/42

[52] U.S. Cl. ..... 42/103; 42/100; 33/234; 33/241

[58] Field of Search ..... 33/234, 241; 42/100, 42/103

[56] References Cited

U.S. PATENT DOCUMENTS

| | | | |
|---|---|---|---|
| 2,380,965 | 8/1945 | Harvey | 42/100 |
| 2,430,469 | 11/1947 | Karnes | 42/103 |
| 2,555,888 | 6/1951 | Klein | 33/241 |
| 2,987,821 | 6/1961 | Kettler | 33/241 |
| 3,678,590 | 7/1972 | Hayward | 42/103 |
| 3,698,092 | 10/1972 | Rosenhan | 42/103 |
| 3,820,248 | 6/1974 | Hayward | 33/241 |
| 4,016,652 | 4/1977 | Stratman | 42/100 |
| 4,707,772 | 11/1987 | Jimenez et al. | 33/241 |
| 4,745,698 | 5/1988 | Schwulst | 42/100 |

OTHER PUBLICATIONS

Carpenter, Metallic Sights Still Fill a Need, American Rifleman, Aug. 1981, pp. 24–27.

*Primary Examiner*—Charles T. Jordan
*Assistant Examiner*—Richard W. Wendtland
*Attorney, Agent, or Firm*—Leon Gilden

[57] ABSTRACT

Apparatus including a front sight aligned with a rear sight mounted coaxial relative to one another overlying a barrel portion of an associated rifle. The front sight is of a generally Y-shaped configuration including a matrix of luminescent dots with a plurality of such dots aligned with a front sight blade and a rear cylindrical sight including a windage luminescent strip member radially aligned with the rear sight for alignment with the front sight luminescent members. Further, the invention contemplates utilizing an accessory artificial light member to enhance illumination of the luminescent members as required.

6 Claims, 4 Drawing Sheets

PRIOR ART

NOCTURNAL RIFLE SIGHT ORGANIZATION

BACKGROUND OF THE INVENTION

1. Field of the Invention

The field of the invention relates to rifle sight organizations, and more particularly pertains to a new and improved nocturnal rifle sight organization wherein the same permits ease of alignment and viewing of rifle sights during periods of limited light.

2. Description of the Prior Art

Proper aiming and discharge of firearms particularly in conditions of limited light have historically posed a problem. During sighting of an associated rifle, proper alignment of a rear sight with a front sight for aiming of the associated impact of a projectile requires visibility to a certain degree of the associated firearms sighting apparatus to permit such discharge of the weapon.

The instant invention attempts to overcome the deficiencies of the prior art by providing a readily aligned and quickly and easily visible sighting arrangement to permit adjustment in windage and elevation of a rifle sighting arrangement. Examples of the prior art include U.S. Pat. No. 3,698,092 to ROSENHAN wherein the same utilizes spaced forward and rear sight members utilizing lightly colored patches cooperative with a light source mounted within each of the sighting members to permit alignment of the sighting members for a sighting disposition of the associated rifle.

U.S. Pat. No. 3,678,590 to HAYWARD sets forth a rifle sighting arrangement wherein a fiber optic cable is directed to a forward and rear sight for illumination of the sights for sighting purposes.

U.S. Pat. No. 3,820,248 to HAYWARD utilizes illumination gun sight including luminescent members aligned within a tube for sighting of an associated rifle.

U.S. Pat. No. 2,555,888 to KLEIN sets forth a rear ocular sight mounting an array of colored dots for alignment of the rear sight with a forwardly positioned sight.

U.S. Pat. No. 4,745,698 to SCHWULST sets forth a weapons sighting apparatus wherein the front sight includes a light colored or light emitting area visible only to the eye of an individual viewing directly through a rear sight.

U.S. Pat. No. 2,987,821 to KETTLER utilizes a night sight including luminescent spot applied to a front sight associated with luminescent member mounted to the rear sight for alignment of the sights relative to one another.

As such, it may be appreciated that there continues to be a need for a new and improved nocturnal rifle sight organization as set forth by the instant invention which addresses both the problems of ease in alignment in sighting of an associated rifle as well as effectiveness in construction to effect the sighting of the rifle and in this respect, the present invention substantially fulfills this need.

SUMMARY OF THE INVENTION

In view of the foregoing disadvantages inherent in the known types of rifle sighting arrangements present in the prior art, the present invention provides a new and improved nocturnal rifle sight organization wherein the same permits alignment of rifle sights during conditions of limited light. As such, the general purpose of the present invention, which will be described subsequently in greater detail, is to provide a new and improved nocturnal rifle sight organization which has all the advantages of the prior art rifle sight apparatus and none of the disadvantages.

To attain this, the nocturnal rifle sight organization of the instant invention includes apparatus including a front sight aligned with a rear sight mounted coaxial relative to one another overlying a barrel portion of an associated rifle. The front sight is of a generally Y-shaped configuration including a matrix of luminescent dots with a plurality of such dots aligned with a front sight blade and a rear cylindrical sight including a windage luminescent strip member radially aligned with the rear sight for alignment with the front sight luminescent members. Further, the invention contemplates utilizing an accessory artificial light member to enhance illumination of the luminescent members as required.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved nocturnal rifle sight organization which has all the advantages of the prior art nocturnal rifle sight organizations and none of the disadvantages.

It is another object of the present invention to provide a new and improved nocturnal rifle sight organization which may be easily and efficiently manufactured and marketed.

It is a further object of the present invention to provide a new and improved nocturnal rifle sight organization which is of a durable and reliable construction.

An even further object of the present invention is to provide a new and improved nocturnal rifle sight organization which is susceptible of a low cost of manufacture with regard to both materials and labor, and which accordingly is then susceptible of low prices of sale to the consuming public, thereby making such nocturnal rifle sight organizations economically available to the buying public.

Still yet another object of the present invention is to provide a new and improved nocturnal rifle sight organization which provides in the apparatuses and methods of the prior art some of the advantages thereof, while simultaneously overcoming some of the disadvantages normally associated therewith.

Still another object of the present invention is to provide a new and improved nocturnal rifle sight organization which may be compactly stored when not being utilized.

Yet another object of the present invention is to provide a new and improved nocturnal rifle sight organization wherein the same permits ease of visibility and sighting of rifle sights during nocturnal conditions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
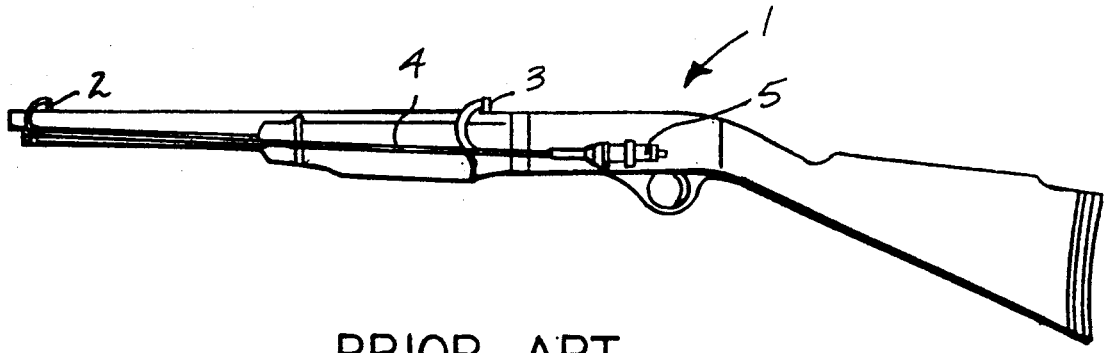
FIG. 1 is an orthographic side view taken in elevation of a prior art rifle sighting apparatus.

With reference now to the drawings, and in particular to FIGS. 1 to 10 thereof, a new and improved nocturnal rifle sight organization embodying the principles and concepts of the present invention and generally designated by the reference numeral 10 will be described.

Figure 2:
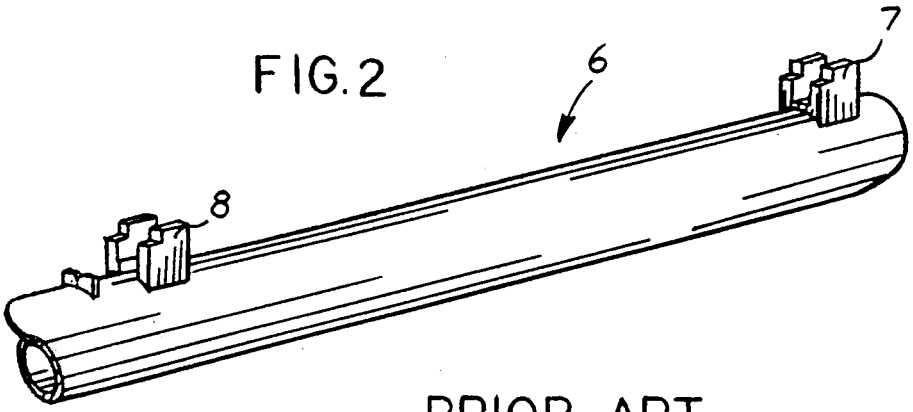
PRIOR ART FIG. 2
FIG. 2 is an isometric illustration of a further example of a rifle sighting apparatus.
Figure 3:
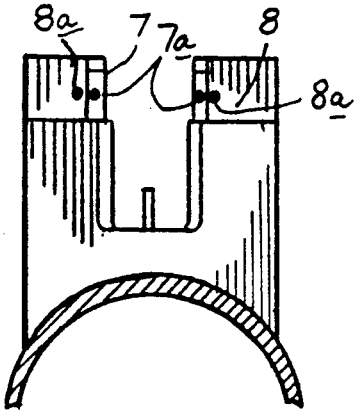
PRIOR ART FIG. 3.
FIG. 3 is an orthographic frontal view taken in elevation of a rifle sight member as illustrated in FIG. 2.
Figure 4:
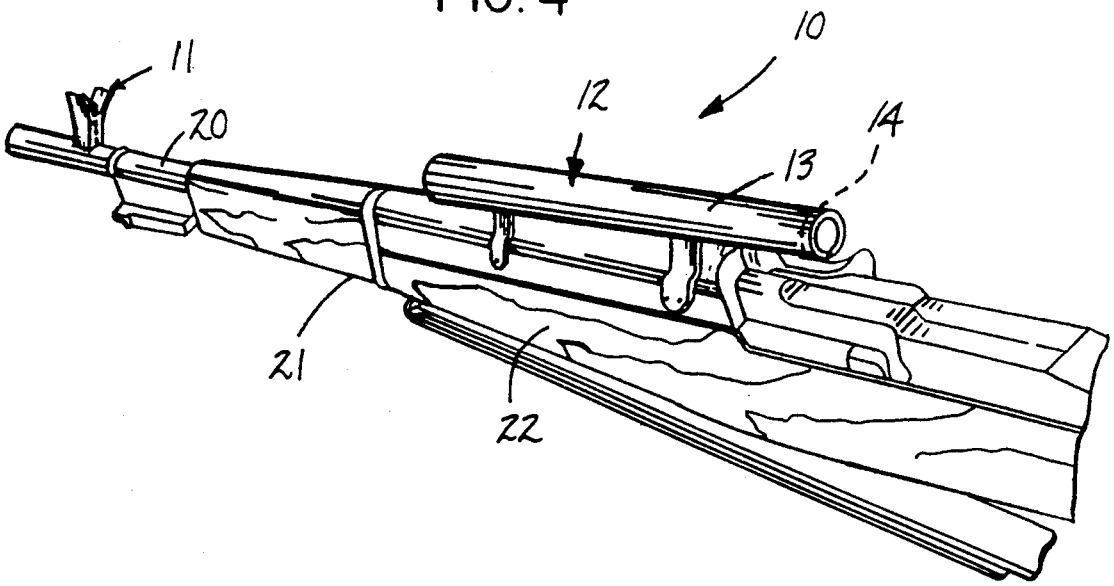
FIG. 4 is an isometric illustration of the instant invention.

Reference to FIG. 1 illustrates a prior art rifle sighting apparatus 1 wherein a forward sight 2 and a rear sight 3 are each in association with a fiber optic transmission line 4 directing illumination from illumination source 5. The apparatus as illustrated in FIG. 2 utilizes a forward and rear sighting member 7 and 8 respectively wherein each member (see FIG. 3) utilizes a respective forward illumination members 7 and 8 aligned with forward illumination members 8*a* for alignment of the sights prior to discharge of the associated firearm.

Figure 5:
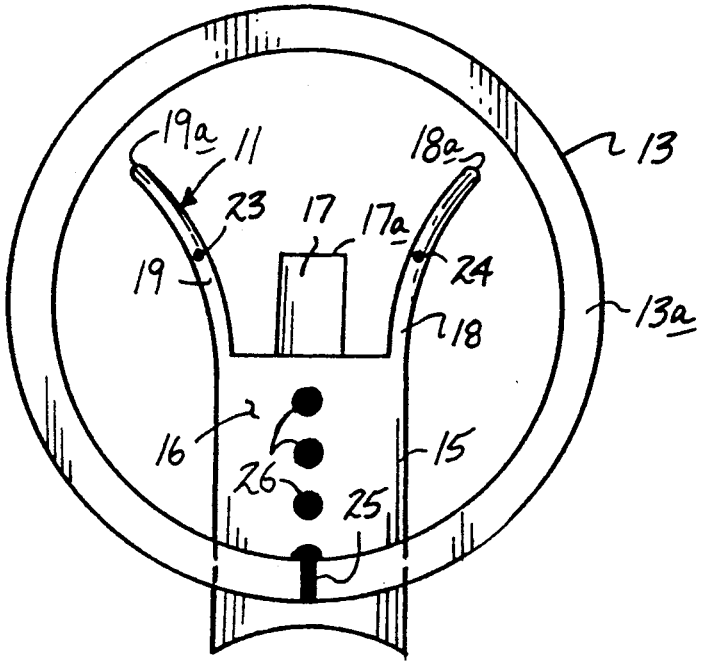
FIG. 5 is an orthographic end view taken in elevation of the instant invention.

More specifically, the nocturnal rifle sight organization 10 of the instant invention essentially includes a forward sight member 11 of a generally Y-shaped configuration mounted adjacent a forward end of an associated rifle barrel 20 longitudinally aligned with a rifle 21 including a rifle stock 22. A rear sight member 12 is mounted overlying the barrel 20 coaxially aligned with the rifle barrel and forward sight 11. The rear sight member 12 is formed as elongate cylindrical sight 13 defined by a predetermined magnification or alternatively may be defined as a peep sight ring 14 defining a ring like centering rear sight for association with a central blade 17 mounted medially to a top surface of the central vertical post 15 of the forward sight 11. The central vertical post 15 further includes a planar forward face 16 orthogonally aligned with the axis of the rifle barrel 20 mounting an aligned series of equally spaced luminescent elevational dots 26 thereon in a vertical array as illustrated in FIG. 5 for example. The central vertical post 15 further includes a respective right and left concave arcuate leg 18 and 19 respectively each extending upwardly from opposed sides of the central vertical post 15 defining confronting convex surfaces and each including a respective upper right leg terminal end 18*a* and an upper left leg upper terminal end 19*a*. The right leg 18 includes a right luminescent alignment dot 24 aligned with the top surface 17*a* of the blade 17 wherein the left leg 19 includes a left luminescent alignment dot 23 aligned with the right luminescent alignment dot 24 and the top surface 17*a* of the blade 17. The forward surface of the cylindrical sight 13 includes an illumination windage band 25 radially aligned with the axis of the cylinder 13 or the ring 14 at a lower-most end of the rear surface of the ring 14 or the cylinder 13. Accordingly it may be understood that the windage sight band 25 during conditions of limited visibility is aligned with one of the series of spaced elevational dots 26 mounted on the forward face 16. Further, the top surface 17*a* of the blade 17 may further be formed of luminescent material to thereby define a line when viewed through the rear ring 14 to accordingly align the top surface 17*a* with the spaced left and right alignment dots 23 and 24.

Figure 6:
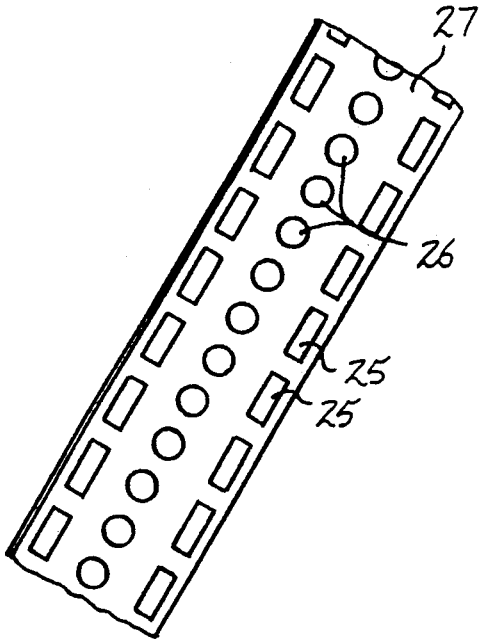
FIG. 6 is an isometric illustration of luminescent tape utilized by the instant invention.

FIG. 6 illustrates the use of a luminescent strip 27 defining removable adhesively mountable luminescent dots 26 and bands 25 to be mounted upon the said organization as required.

Figure 7:
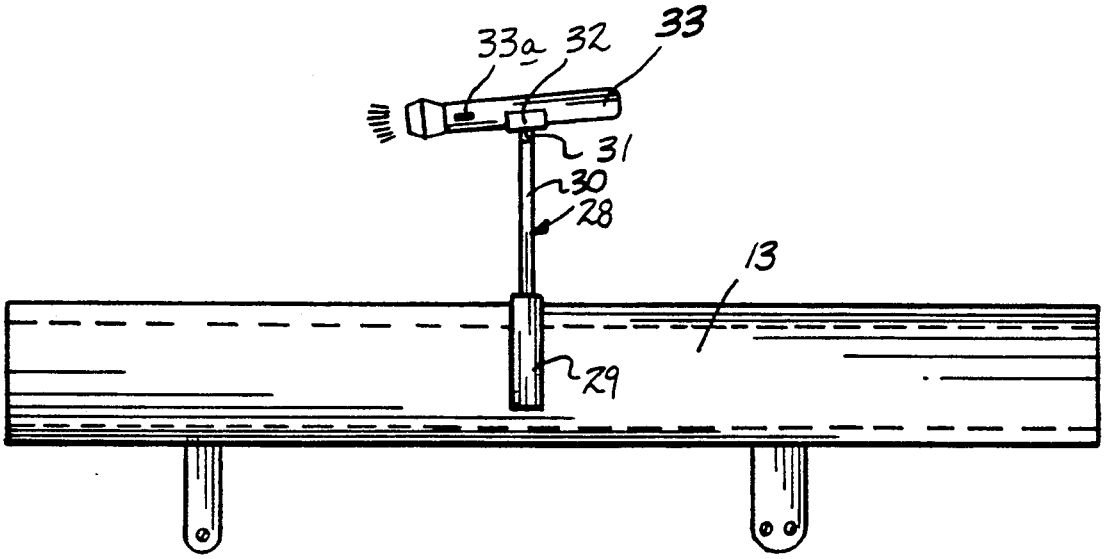
FIG. 7 is an orthographic side view taken in elevation of the instant invention utilizing illumination source.
Figure 8:
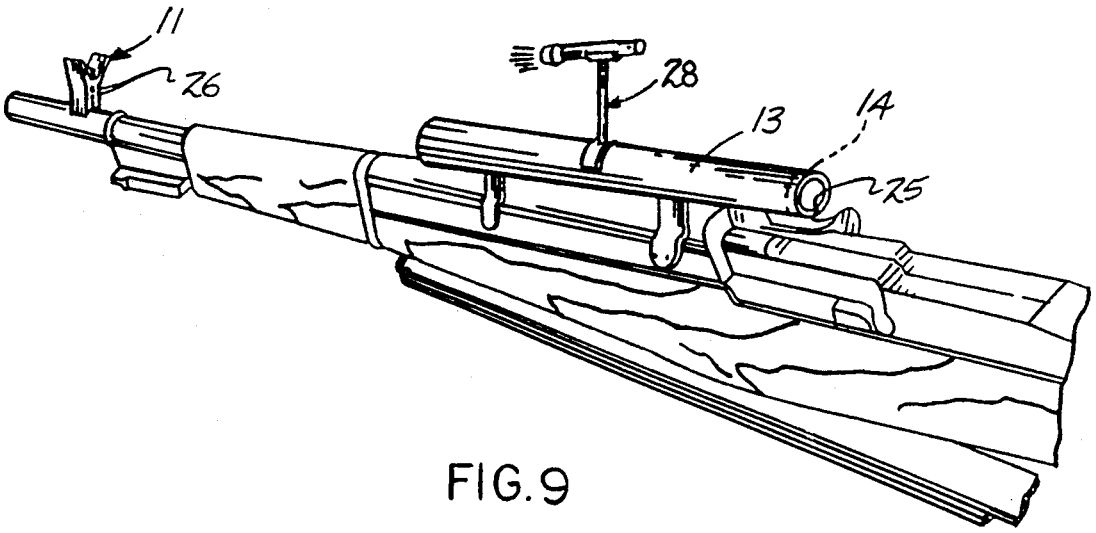
FIG. 8 is an isometric illustration of the instant invention mounting the illumination source upon an associated sighting system of the instant invention.

Further, FIG. 7 illustrates the use of illumination source 33 utilizing a semi-cylindrical arcuate yoke base 29 and support rod 30 mounted medially of a top surface of the base 29 and radially aligned therewith to extend in a vertical orientation with the upper terminal end of the support rod 30 pivotally mounted to an arcuate saddle 32 directed upwardly therefrom about a pivot connection 31. The arcuate saddle fixedly secures an elongate forwardly directed illumination source 33 utilizing a switch 33*a* to selectively actuate this illumination source. Understandably, the illumination source may be fixedly mounted to a top surface of the cylindrical sight 13 and directed forwardly for enhanced illumination of the luminescent members 23, 24, 25, 26, and alternatively 17*a* as required.

Figure 9:
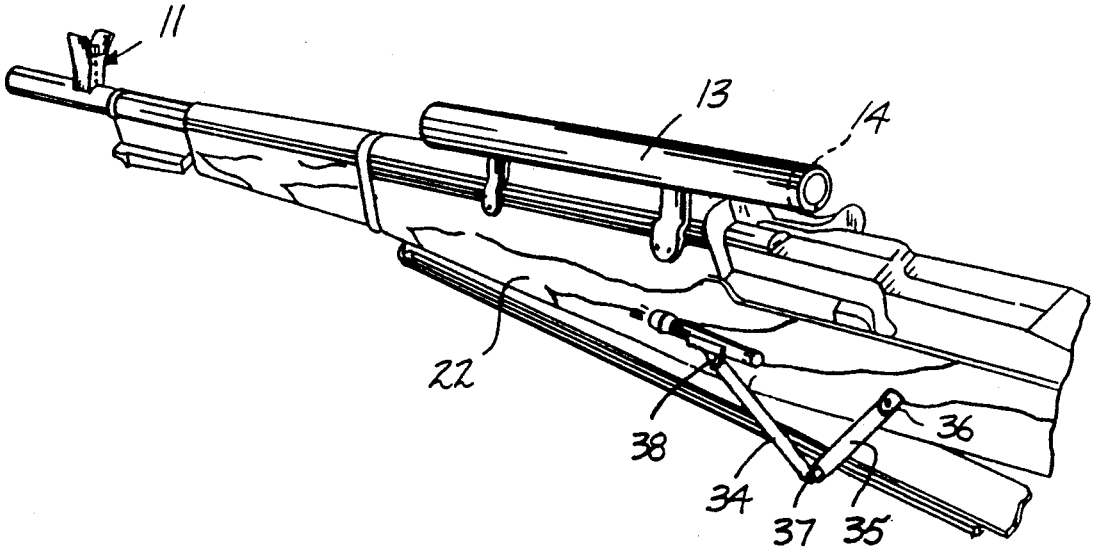
FIG. 9 is an isometric illustration of a modification of the illumination mount utilized by the instant invention.
Figure 10:
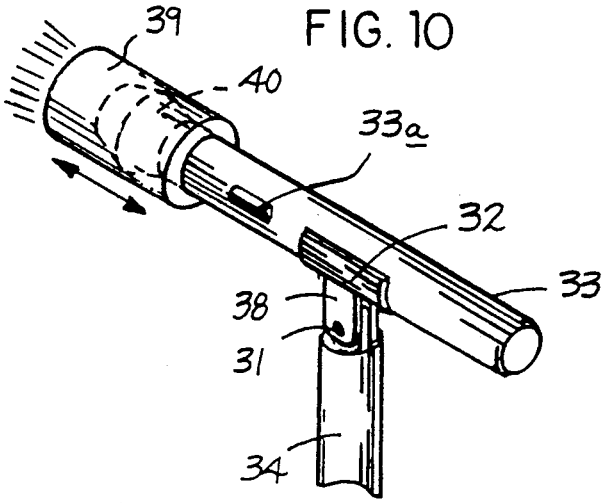
FIG. 10 is an isometric illustration somewhat enlarged of the illumination member utilized by the instant invention.

FIG. 9 illustrates a modified mounting of the illumination source wherein a first link 34 includes a frictional link pivot 37 mounting the first link 34 to a second link 35 wherein the second link 35 includes a pivot mount 36 to frictionally and pivotally mount the second link 35 to a side surface of the rifle stock 22 rearwardly of the cylindrical sight 13 or 14. A bifurcated saddle support 38 (see FIG. 10) utilizes a pivot connection 31 to frictionally and pivotally mount the arcuate saddle 32 to an upper end of the first link 34 or the support rod 30. A slide cylindrical housing 39 mounted in surrounding relationship relative to the illumination housing forward end 40 of the illumination source to provide shielding of the illumination source and further direct the illumination from the illumination source forwardly through the tubular housing 39 to the forward sight member 11.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A nocturnal rifle sight apparatus for use with a rifle including an elongate coaxially aligned rifle barrel mounted within an elongate rifle stock, the apparatus including a front sight member fixedly mounted to the rifle barrel at a forward end thereof coaxially aligned with a rear sight member fixedly mounted overlying the rifle barrel, the forward sight member defining a "Y" shaped configuration, and the rear sight member defining a cylindrical sight wherein the cylindrical sight defines a cylindrical sight axis bisecting the "Y" shaped configuration of the forward sight member, and the "Y" shaped configuration including a central vertical post wherein the central vertical post includes a planar forward face, and a left arcuate leg extending upwardly and laterally of the central vertical post, and a right arcuate leg extending upwardly and laterally of the central vertical post wherein the right and left arcuate legs each define confronting convex surfaces, and wherein the central vertical post includes a central blade integrally and orthogonally mounted to a top surface of the central vertical post, the central blade including a blade top surface, and including a plurality of aligned equally spaced luminescent elevational dots fixedly mounted to the planar forward face underlying and aligned with the central blade.

2. Apparatus as set forth in claim 1 including a left luminescent alignment dot mounted on a forward end surface of the left arcuate leg, and a right luminescent alignment dot mounted on a forward end surface of the right arcuate leg wherein the right and left luminescent alignment dots are in alignment with the blade top surface.

3. Apparatus as set forth in claim 2 wherein the blade top surface is luminescent and wherein the left luminescent dot, the right luminescent dot and the blade top surface are aligned relative to one another.

4. Apparatus as set forth in claim 3 wherein the rear sight member includes a rear annular surface, the rear annular surface including a luminescent windage band radially aligned with the rear end surface and fixedly mounted thereon at a lower terminal end thereof for selective alignment with one of said luminescent elevational dots.

5. Apparatus as set forth in claim 4 further including an illumination source wherein the illumination source includes a switch for selective actuation of the illumination source, the illumination source mounted within a concave saddle, the saddle including a pivot connection, the pivot connection mounted to a support rod, and the support rod mounted to a concave yoke base, the yoke base fixedly mounted to a top surface of the rear sight member.

6. Apparatus as set forth in claim 4 including an elongate illumination source, the elongate illumination source including a switch for selective illumination of the illumination source, and a sleeve slidably mounted about a forward end of the illumination source, and the illumination source mounted within a concave arcuate saddle, the arcuate saddle including a bifurcated saddle support fixedly and radially aligned with the arcuate saddle, the bifurcated support including a pivot connection directed orthogonally therethrough, the pivot connection pivotally mounting the saddle support to a first link, the first link pivotally mounted to a second link, and a pivot mount frictionally and pivotally mounting the first link to the second link, and the second link including a link pivot, the link pivot pivotally mounting the second link to the rifle stock onto a side surface of the rifle stock for selective articulation of the illumination source relative to the forward sight member.

* * * * *